United States Patent [19]

Scholz

[11] Patent Number: 4,562,766

[45] Date of Patent: Jan. 7, 1986

[54] STRING TUNING AND FASTENING ARRANGEMENT

[76] Inventor: Donald T. Scholz, 13 Rich Valley Rd., Wayland, Mass. 01778

[21] Appl. No.: 501,441

[22] Filed: Jun. 6, 1983

[51] Int. Cl.[4] ..... G10D 3/14

[52] U.S. Cl. ..... 84/297 R; 84/205; 84/312 R

[58] Field of Search ..... 84/205, 304, 297 R, 84/312 R, 312 P, 207

[56] References Cited

U.S. PATENT DOCUMENTS

| | | | |
|---|---|---|---|
| 974,095 | 10/1910 | Schlemmer | 84/297 R |
| 1,431,250 | 10/1922 | Oettinger | 84/312 R |
| 2,241,284 | 5/1941 | Walder | 84/312 R |
| 2,322,137 | 6/1943 | Jauch | 84/297 R |
| 3,407,696 | 10/1968 | Smith et al. | 84/297 R |
| 3,596,552 | 8/1971 | Jager | 84/297 R |
| 4,141,271 | 2/1979 | Mullen | 84/312 P |
| 4,378,723 | 4/1983 | Scholz | 84/297 R |

*Primary Examiner*—Benjamin R. Fuller

*Attorney, Agent, or Firm*—Wolf, Greenfield & Sacks

[57] ABSTRACT

A stringed musical instrument has separate members commonly mounted at the head of the instrument for providing individual support and adjustment for each of the strings. Each fastening and tuning member comprises an elongated support piece carrying a clamping member that engages and clamps the string. The clamping member comprises a lever member releasably moved to a locked position for providing positive engagement with the string. The tension in the string is adjusted for tuning purposes by longitudinally displacing the elongated support piece.

14 Claims, 8 Drawing Figures

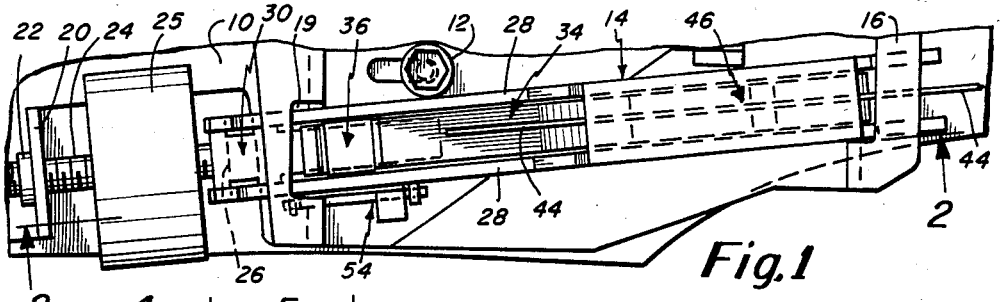
Fig. 1
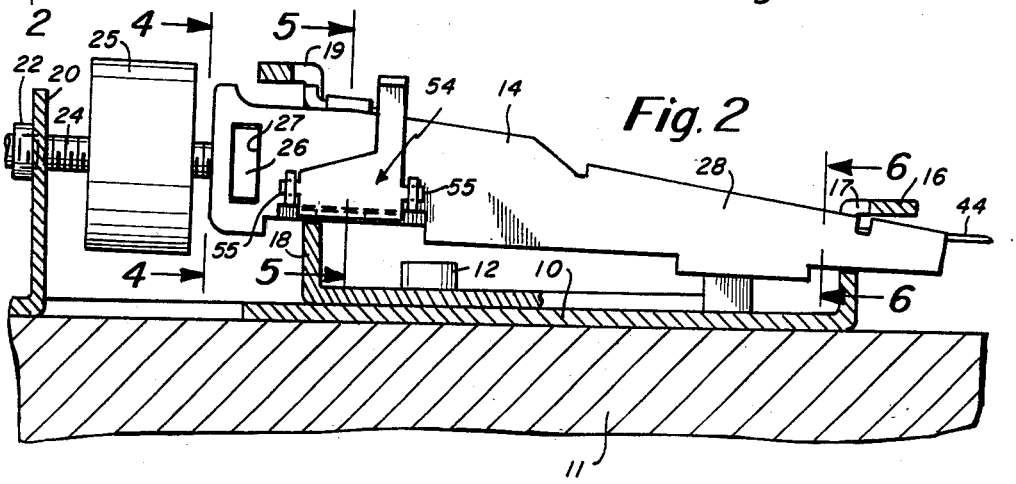
Fig. 2
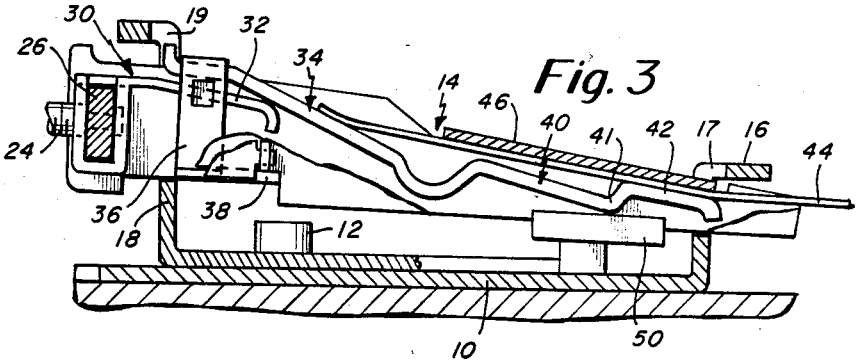
Fig. 3
Fig. 4
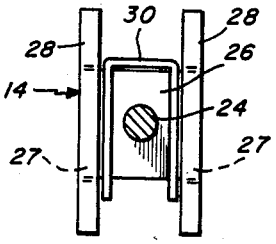
Fig. 5
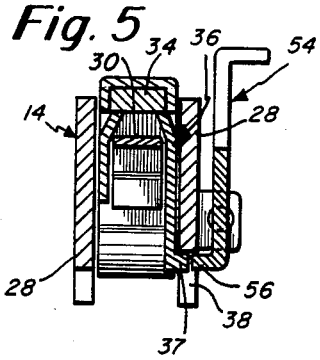
Fig. 6
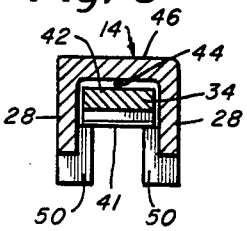

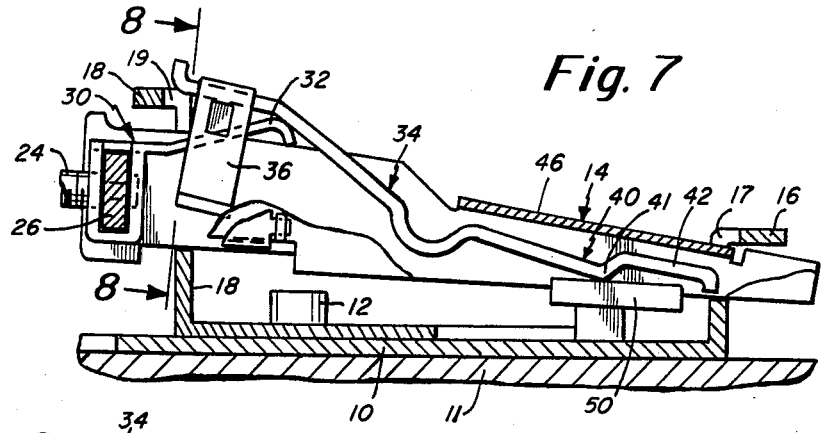
Fig. 7
Fig. 8
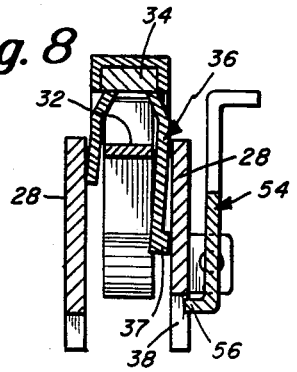

STRING TUNING AND FASTENING ARRANGEMENT

BACKGROUND OF THE INVENTION

The present invention relates in general to stringed musical instruments and pertains, more particularly, to an improved string tuning and fastening apparatus, preferably employed at the head of a stringed instrument and for providing both improved securing or clamping of each string individually, and improved fine adjustment of the tension of each string individually.

In a conventional guitar or other stringed instrument, the adjustment of the strings is usually accomplished at the head of the instrument and this adjustment means usually comprises a series of pegs or keys which are rotatable for individually varying the tension on each string. The peg typically has a hole through which the string must be passed and tied. However, the problem is that the string tends to slip on the peg and there is usually a need for continuous adjustment of the individual strings. Furthermore, with the conventional arrangement, each of the strings is tied to its associated peg or key at a relatively long distance from the instrument nut and there is a bending of the string near the peg or key. This is undesirable in that there may well be unequal tensions in the string on opposite sides of the nut due to friction at the nut. In accordance with the present invention it is preferred to have the clamping of the string occur by an improved clamping member wherein the clamping occurs relatively close to the nut with each string being clamped so as to cause little or no bending of the string near the clamp.

Accordingly, one object of the present invention is to provide an improved fastening and tuning arrangement for use with a stringed musical instrument and which alleviates the prior art problems typically associated with the use of a conventional adjusting lug, peg or key.

Another object of the present invention is to provide an improved tuning and securing member characterized by an improved clamping lever member that provides clamping along a short segment of the string close to the nut. This "short segment" clamping concept is employed preferrably in accordance with the present invention in combination with a means for longitudinally displacing the clamping lever member such as by the use of an elongated support piece for carrying the lever member.

Various types of tuning, adjusting, and securing members are disclosed in such prior art patents as Leger U.S. Pat. No. 3,596,552; Walder U.S. Pat. No. 2,241,284; Jauch U.S. Pat. No. 2,322,137; Oettinger U.S. Pat. No. 1,431,250; Schlemmer U.S. Pat. No. 974,095; and Smith, et al U.S. Pat. No. 3,407,696. These patents all typically show string support means that employ some type of a pivot arrangement. For example, see the Oettinger and Jauch patents. It does not appear from any of these prior art patents that they teach the concept of the present invention of longitudinally clamping the string without causing bending in the tensioned portion of the string. There is also string, particularly in combination with the longitudinal movement of the clamping mechanism to provide fine tuning. Furthermore, many of these patents teach an adjusting feature, not at the head of the instrument but instead at the base of the instrument. It is noted that in both the Jauch and Oettinger patents that the adjustment is provided at the body of the instrument and not at the fingerboard end.

Thus, another object in accordance with the present invention is to provide an individual string tuning member adapted for replacement of conventional tuning pegs and the like mounted at the head of the instrument and wherein each of the strings is longitudinally clamped at a position closely adjacent to the nut of the instrument.

SUMMARY OF THE INVENTION

To accomplish the foregoing and other objects of this invention, there is provided a fastening and tuning apparatus comprising a support base secured to the head of the instrument and adapted to carry a plurality of separate adjusting means corresponding in number to the number of strings of the stringed instrument. Each fastening and adjusting means comprises an elongated support piece which in turn carries a clamping lever member supported in the elongated support piece. The support piece has means defining a fulcrum for the clamping lever member. The lever member also has one end adjacent and close to the fulcrum which is adapted to clamp the musical instrument string between the one end and an underside surface of the support piece. The other free end of the lever member is adapted to be moved from a released position to a locked position. An actuating element or release means is used to release the lever member when it is desired to remove or replace the string. There is provided a spring for biasing the lever member toward its released position. The string adjustment or tuning may be accomplished by means of a separate manually adjustable means for providing the fine longitudinal displacement of the elongated support piece. In one embodiment, the manually adjustable means is in the form of a lead screw with a thumb wheel.

BRIEF DESCRIPTION OF THE DRAWINGS

Numerous other objects, features and advantages of the invention should now become apparent upon a reading of the following detailed description taken in conjunction with the accompanying drawing, in which:

FIG. 1 is a fragmentary plan view of a head of a stringed musical instrument such as a guitar showing the tuning and fastening apparatus of this invention;

FIG. 2 is a cross-sectional view taken along line 2—2 of FIG. 1;

FIG. 3 is a cross-sectional view similar to the view of FIG. 2 but with part of the adjusting member cut away to show the internal clamping lever member;

FIG. 4 is a cross-sectional view taken along line 4—4 of FIG. 2;

FIG. 5 is a cross-sectional view taken along line 5—5 of FIG. 2;

FIG. 6 is a cross-sectional view taken along line 6—6 of FIG. 2;

FIG. 7 is a cross-sectional view like that shown in FIG. 3 but with the clamping lever member in its released position; and FIG. 8 is a cross-sectional view taken along line 8—8 of FIG. 7.

DETAILED DESCRIPTION

Referring now to the drawings, there is shown a preferred embodiment of the string tuning and fastening apparatus of this invention. The details of the apparatus are depicted in FIGS. 1–6. In addition, FIGS. 7 and 8 illustrate the string tuning and fastening arrangement in its released position. Note in particular the view illustrated in FIG. 3 which shows the string fastener in its fastening or locked position with the string firmly in place.

The string tuning and fastening arrangement of this invention comprises a support base 10 which is fixed to the body 11 of the stringed musical instrument. Bolts 12 are used to secure the support base to the musical instrument body.

The support base 10 supports a plurality of individual support pieces 14 with a number of these support pieces corresponding to the number of strings. For the sake of simplicity, in the drawings, such as in FIG. 1, only one of the support pieces is shown.

As illustrated in FIGS. 1–3, the support piece 14 is supported between the turned end 16 of the support base 10 and a rear support member 18. The end 16 has an aperture 17 for receiving one end of the support piece and similarly, the member 18 has an aperture 19 for receiving an opposite end of the support piece 14. And also, as illustrated in FIGS. 1 and 2, the support base 10 has a rear upright wall 20 that is integral with the support base and has secured thereto a nut 22 which receives the rotating lead screw 24. The lead screw 24 has affixed thereto the thumbwheel 25. By rotation of the thumbwheel 25 this in turn causes rotation of the lead screw 24 in the nut 22 so as to cause horizontal movement of support piece 14 to either the left or right as viewed in FIG. 2. The movement of the support piece 14 is facilitated by means of the lead screw 24 having one end captured by a support member 26 illustrated in detail in FIG. 3. The lead screw 24 is free to rotate in the member 26. As also illustrated in FIG. 4, the support member 26 is adapted to fit inside disposed apertures 27 in the sidewalls 28 of the support piece 14.

The support member 26, as also illustrated in FIG. 4, further supports the spring 30. The placement of the spring 30 is clearly illustrated in FIGS. 3 and 7. It is noted that the spring 30 includes an arm 32 which is adapted to bias the lever member 34 to a released position as illustrated in FIG. 7. The arm 32 engages an underside of the lever member 34 as illustrated in FIGS. 3 and 7.

The aforementioned lever member 34 is supported in the support piece 10 as illustrated in FIG. 3 and carries at one end the locking member 36. The locking member 36 has on one side a catch 37 clearly illustrated in FIGS. 5 and 8 which fits within the aperture 38 in one of the sidewalls 28 of the support piece 14. FIG. 5 illustrates the locking member 36 in its locked position.

The lever member 34 also has at a free end 40 a pivot point 41 formed by a bend in the lever member. Adjacent to the pivot point 41 is a substantially flat segment 42 which represents the portion of the lever member that bears against the string 44 as clearly illustrated in FIG. 3. In this connection it is noted that the support piece 14 has a top wall 46 that interconnects the upright walls 28. The string 44 is sandwiched between the segment 42 of the support lever 34 and the wall 46.

The lever member 34, particularly at its pivot point 41, pivots by contact at point 41 with a fulcrum defined by wall members 50. Again, reference may be made to FIG. 3 which shows the contact at the pivot point with the wall members 50. Also refer to FIG. 6 which shows the spaced wall members and the contact with the lever member. It is noted that the wall members 50 are of a wider width in comparison to the sidewalls 28 so as to provide a ridge at the top of each of these members with which the lever member contacts at its pivot point 41.

Now, in the position of FIG. 3, the locking member 36 is shown in its locked position with its end 37 engaged in the aperture 38 in one of the sidewalls 28 of the support piece 14. The lever member 28 may be moved to that position by simply moving the lever member at its left end as viewed in FIG. 3 downwardly until the catch 37 engages into the aperture 38. This downward movement is against the bias provided by the arm 32 of spring 30. When this occurs, there is a pivoting of the lever member at pivot point 41 about the fulcrum provided by the wall members 50 and thus along the segment 42 of the lever member there is intense force imposed upon a short segment of the string 44 causing the string 44 to be securely and tightly fastened between the segment 42 and the top wall 46 of the support piece 14. It is noted that the mechanical advantage is very substantial with the lever member of this invention due to the fact that the lever arm from pivot point 41 to the locking member 36 is quite long in comparison to the length of the contact segment 42. Thus, for every pound of force applied in a locking the lever member in place, this force is multiplied as far as the force with which the segment 42 contacts the spring 44.

Now, for release of the lever member 34, reference is made to FIGS. 7 and 8. Also, reference is made to the release member 54 illustrated in FIGS. 2, 5 and 8. The release member 54 is supported in a pivotal fashion by end pivot supports 55 from the sidewall 28 that has the aperture 38. Again, FIG. 5 illustrates the release member 54 in its non-released state with the lever member being locked into position. It is noted that the release member 54 has a bottom end 56 that may be moved inwardly to engage the catch 37 of the locking member 36. The release member 54 is simply rotated in a clockwise direction as viewed in FIGS. 5 and 8 so that there is contact with the catch 37 to move the catch sufficiently so that it clears the sidewall 28. With this movement, and by means of the bias provided by spring 30, the locking member 36 and associated end of the lever member 34 moves upwardly to the position illustrated in FIGS. 7 and 8. This releases the force on the string imposed by the segment 42 at the opposite end of the lever member 34. Once the lever member has been moved to the position illustrated in FIGS. 7 and 8 then the string can easily be withdrawn from the support piece.

Having now described one embodiment of the present invention, it should now be apparent to those skilled in the art that numerous other embodiments are contemplated as following within the scope of this invention as defined by the appended claims.

What is claimed is:

1. String tuning and fastening apparatus for a stringed musical instrument secured to the instrument for supporting one end of each string and comprising;

a lever member having means defining a pivot point thereof and means defining a clamping segment thereof adjacent said pivot point, a support piece for said lever member having means defining a fulcrum arranged to cooperatively receive said pivot point with the lever member free to pivot in said support piece about said pivot point, means on said lever member for locking said lever member to said support piece with the clamping segment of said lever member adapted to clamp the string, and means supported adjacent said lever member for releasing said means for locking and in releasing said lever member to permit removal of the clamping force of the clamping segment on the string.

2. String tuning and fastening apparatus for a stringed musical instrument as in claim 1 wherein said lever member is elongated having said means of locking disposed at one end of the lever member remote from said clamping segment.

3. String tuning and fastening apparatus for a stringed musical instrument as in claim 2 wherein the distance from the means for locking to the pivot point is greater than the distance from the pivot joint to the clamping segment.

4. String tuning and fastening apparatus for a stringed musical instrument as in claim 3 wherein said means for locking includes a U-shaped member having a catch that engages with an aperture of the support piece.

5. String tuning and fastening apparatus for a stringed musical instrument as in claim 4 wherein said support piece has sidewalls forming a channel for receiving the lever member.

6. String tuning and fastening apparatus for a stringed musical instrument as in claim 1 wherein said support piece has sidewalls forming a channel for receiving the lever member.

7. String tuning and fastening apparatus for a stringed musical instrument as in claim 6 wherein said fulcrum is formed by a pair of spaced wall members associated respectively with the sidewalls.

8. String tuning and fastening apparatus for a stringed musical instrument as in claim 7 wherein said support piece also has a top wall interconnecting the sidewalls with the string being captured between the clamping segments of the lever member and the underside of the top wall.

9. String tuning and fastening apparatus for a stringed musical instrument as in claim 8 wherein said pivot point is formed by a turn in the lever member and wherein said clamping segment is flat and substantially parallel to said top wall.

10. String tuning and fastening apparatus for a stringed musical instrument as in claim 1 including means for biasing the lever member toward a released position of the lever member.

11. String tuning and fastening apparatus for a stringed musical instrument as in claim 10 wherein said means for biasing comprises a spring including a spring arm extending to the underside of the lever member.

12. String tuning and fastening apparatus for a stringed musical instrument as in claim 11 including a support member extending between sidewalls of the support piece for supporting the spring.

13. String tuning and fastening apparatus for a stringed musical instrument as in claim 12 including means for laterally moving the support piece comprising a lead screw support at one end by the support member.

14. String tuning and fastening apparatus for a stringed musical instrument as in claim 13 wherein said means for releasing includes means for moving said locking means.

* * * * *